United States Patent [19]

Braasch

[11] Patent Number: 4,964,245

[45] Date of Patent: Oct. 23, 1990

[54] GRINDING ELEMENT FOR A GRINDING TOOL BODY

[76] Inventor: Gerd Braasch, Sassenberg 31, 4475 Sogel, Fed. Rep. of Germany

[21] Appl. No.: 283,283

[22] Filed: Dec. 12, 1988

[30] Foreign Application Priority Data

Dec. 15, 1987 [DE] Fed. Rep. of Germany ... 8716524[U]
Mar. 4, 1988 [DE] Fed. Rep. of Germany ... 8802927[U]

[51] Int. Cl.[5] ..... B24D 11/00
[52] U.S. Cl. ..... 51/407; 51/394; 51/358
[58] Field of Search ..... 51/394, 395, 397, 400, 51/401, 407, DIG. 34, 175, 180

[56] References Cited

U.S. PATENT DOCUMENTS

| | | | |
|---|---|---|---|
| 2,499,933 | 3/1950 | Smul | 51/362 X |
| 2,838,890 | 6/1958 | McIntyre | 51/395 |
| 3,495,362 | 2/1970 | Hillenbrand | 51/395 |
| 4,274,232 | 6/1981 | Wylde | 51/DIG. 34 X |
| 4,287,685 | 9/1981 | Marton | 51/358 X |
| 4,549,371 | 10/1985 | Hakoda | 51/273 X |
| 4,609,581 | 9/1986 | Ott | 51/358 X |

FOREIGN PATENT DOCUMENTS

| | | | |
|---|---|---|---|
| 3413028 | 10/1985 | Fed. Rep. of Germany | 51/273 |
| 76278 | 4/1986 | Japan | 51/358 |

*Primary Examiner*—Robert A. Rose
*Attorney, Agent, or Firm*—Collard, Roe & Galgano

[57] ABSTRACT

A grinding tool body of a vibratory grinding or sanding tool has suction inlets at least in recessed areas of its working surface for sucking away the grinding dust by means of an external suction system connectable with the grinding tool body. The grinding element is in the form of a sheet of grinding linen or grinding paper coated on one side with grinding material and having a second side covering the working surface. The sheet serving as the grinding or sanding element has perforated areas coinciding with the recessed areas in the working surface. The grinding element is held in place on the working surface solely by the suction force produced by the suction system. This allows for the simple and quick replacement of worn grinding elements. The grinding material-free back or second surface of the grinding element is roughened. Preferably, for the purpose of producing such a roughening, at least two edges of the sheet are folded over, such edges being disposed opposite one another.

12 Claims, 3 Drawing Sheets

GRINDING ELEMENT FOR A GRINDING TOOL BODY

BACKGROUND OF THE INVENTION

1. Field of the Invention

This invention relates to a grinding element for a grinding tool body of a vibratory grinding tool. The grinding tool body has suction openings, at least in recessed areas of its working surface, for vacuuming away the grinding dust by means of an external suction system connectable with the body. A sheet of grinding linen or grinding paper, coated on a first side with grinding material, covers the working surface. This sheet has open areas coinciding with the recessed areas of the working surface.

2. Description of the Prior Art

Grinding tool bodies with suction openings arranged in recessed areas have the advantage that the recessed areas do not participate in the grinding operation and thus serve for the formation of suction currents that carry along and discharge the grinding dust collected in the grinding operation. The raised areas of the working surface participating in the grinding have to be equipped with grinding elements that have to be replaced when worn.

In order to permit the simple replacement of grinding elements, a grinding element in the form of a sheet coated on one side with grinding material and covering the working surface is provided. This sheet has open areas coinciding with the recessed areas of the working surface. With a grinding element in the form of a sheet, the total working surface of the grinding body can be covered in one step, and a worn grinding element can be removed as a complete unit in one step, as well. This simplifies the replacement or exchange of grinding elements. As each sheet has open areas coinciding with the recessed areas of the working surface, grinding dust can pass through the openings in the grinding sheet, into the recessed areas of the working surface, from where such dust can be carried along and vacuumed away.

The grinding element may be, for example, a grinding linen, as it is known, which, with respect to its outer dimensions, can be adapted to the dimensions of the working surface of the grinding body by cutting or tearing it to size. Also, the grinding linen may be in the form of a sheet product with a support layer consisting, for example, of plastic fabric. Furthermore, the grinding element may be a grinding or sand paper, which are well known.

The grinding element may be applied to the grinding tool body by simply placing it on the latter, where it may be fastened by fastening means which are well known, for example, by means of clamps or glueing. Also, it is possible to make use of the suction effect of the external suction system for holding the sheet-shaped grinding element on the working surface by the vacuum produced by the suction system. This is readily possible during the grinding operation when the suction system is operating. However, it has been found that the adhesion between the grinding element and the working surface of the grinding tool body is inadequate, if produced solely by the suction effect. Such a suction system is disclosed in a co-pending application of the present inventor based on German priority P 37 42 038.0 and filed concurrently herewith, the teachings of which are incorporated herein.

SUMMARY OF THE INVENTION

It is an object of the invention to provide a grinding element in the form of grinding linen or paper which may be held in place by suction due to an enhanced frictional engagement with the working surface of the grinding tool body.

Accordingly, this object is achieved by significantly enhancing the adhesion of the grinding element produced by the suction effect of the suction system by roughening the grinding material-free back or second side of such element. Such roughening increases the adhesive friction and may be produced by only brushing the back side with a steel brush, for example. Also, such roughening may be limited to predetermined areas of the surface of the back side, if such areas are sufficient for effecting higher adhesive friction.

Furthermore, the roughened zones of the surface may be formed by a layer consisting of a material with high adhesive friction, which layer is applied to the back side of the grinding element. For example, a roughened layer consisting of an application of adhesive material may be glued to the back side, or such a layer may consist of a bonded strip of grinding material, for example, grinding linen or grinding paper. A hot-sealing adhesive may be applied to the back side in the form of a coating which, prior to curing, is roughened by embossing depressions therein, for example, depressions embossed by means of a needle roll. However, in a preferred embodiment, the roughening is formed by folding or bending the edges of the working side of the grinding element over. This permits using the roughening effect of the grinding material overlapping the back side of the grinding element for enhacing the adhesion. This has the advantage that no special measures have to be implemented on the grinding element in order to obtain such a roughening.

As the open areas, for example, the rows of holes, are already present in the grinding sheet, such rows or lines of perforations can be advantageously used as predetermined bending lines for folding or bending the edges over. However, it is also possible to predetermine the bending lines by any other markings on the grinding sheet.

Furthermore, the grinding element is characterized in that the folded edge serving as the roughened layer has at least one hole arranged in a way such that when the sheet is placed on the grinding tool body, the hole coincides with the outlet opening of a suction duct in the form of a bore extending through the grinding tool body. Such a duct ends in the working surface disposed between the recessed areas. An arrangement with at least one hole in the folded edge serving as the roughened layer offers the advantage that it prevents the formation of bumps or swellings caused by displacement of the grinding paper disposed on top of the folded edge in the course of grinding. This is especially important when using a grinding element consisting of relatively thin abrasive paper. This is because the suction force can act through the hole in the folded edge onto the area of the grinding paper disposed on top of this edge.

Each open area can be in the form of a line of holes or perforations, whereby the diameter of such holes can be selected in a way such that they correspond to the width of a recessed area in which the suction openings terminate. Also, each open area can be in the form of an oblong slot. The distance between two adjacent open areas comes to about 10 to 80 millimeters, preferably 40 millimeters. In this way, grinding areas are created between the individual open areas that are sufficiently dimensioned for the desired grinding capacity. On the other hand, the open areas are not excessively wide, so that grinding dust produced in the grinding operation can be sucked away as rapidly as possible through the open areas. In the above embodiment, the width of each folded edge is approximately equal to half the distance between the open areas.

These and other objects and advantages of the present invention will become apparent from the following description of the accompanying drawings, which disclose several embodiments of the invention. It is to be understood that the drawings are to be used for purposes of illustration only, and not as a definition of the invention.

BRIEF DESCRIPTION OF THE DRAWINGS

Further advantages and details can be gleaned from the drawings wherein similar reference numerals denote similar elements throughout the several views.

DESCRIPTION OF THE PREFERRED EMBODIMENTS

Figure 1:
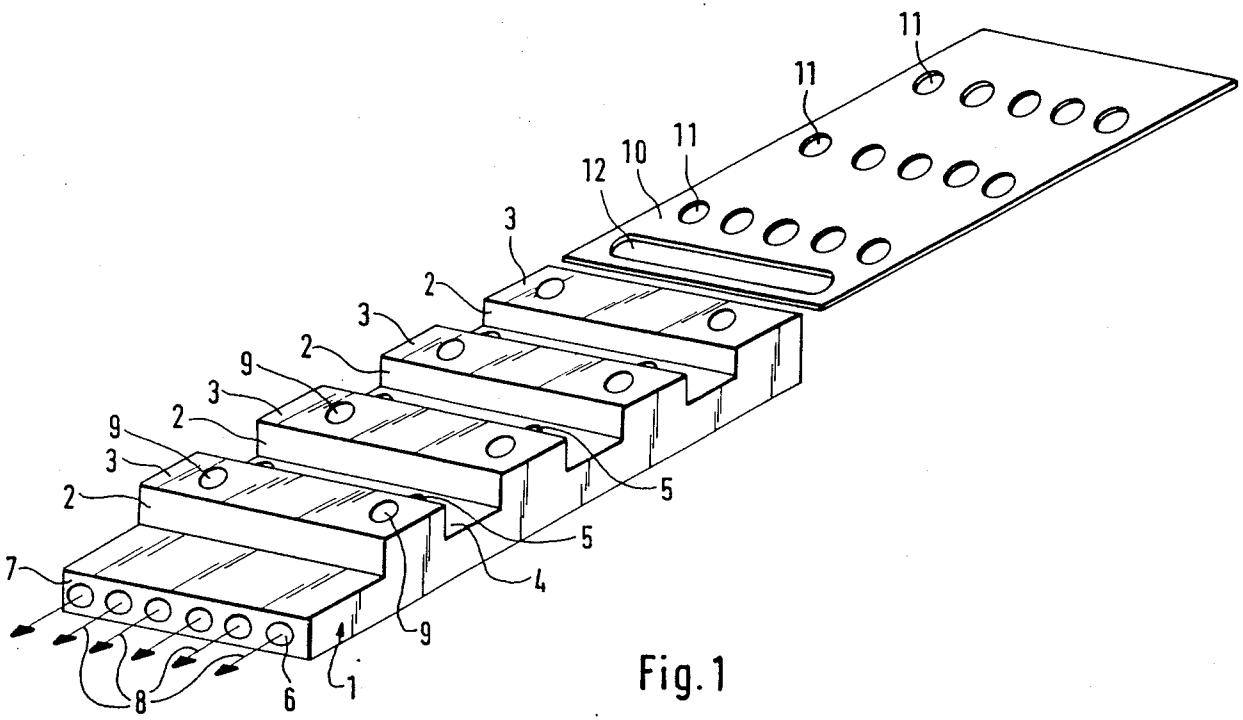
FIG. 1 shows a grinding tool body and a grinding element separated from the working surface thereof.

Referring to FIG. 1, there is shown a grinding tool body, as well as a grinding element removed from the working surface of the body. The body consists of a support plate 1 made from rubber and having projecting bridge-like blocks 2, whose top sides form the working surfaces 3 participating in the grinding operation. The areas 4, which are recessed below and extend between bridge-like blocks 2, have mouths or inlets 5 of suction lines communicating with bore-like ducts 6. Ducts 6 end in the surface of side 7 of the grinding tool body. An external suction system (not shown) is connectable with ducts 6, so that air flowing into inlets 5 is sucked in and through ducts 6, to the external suction system in the direction indicated by the arrows 8. Some of ducts 6 are connected with the outlet openings 9 ending on the top sides of the bridge-like blocks 2. A grinding element sheet 10 adapted for placement on the working side 3 of the bridge-like blocks 2, which element may be, for example, a rectangularly cut piece of grinding linen, is held tightly in place on the exposed top sides of the bridge-like blocks forming the working side 3. Sheet 10 is held by means of the vacuum within outlet openings 9. Sheet 10 has a first side coated with suitable abrasive.

Grinding element or sheet 10 has open areas in the form of the row or line of holes 11. This open area coincides with recessed areas 4 between bridge-like blocks 2. As indicated, the open area may also be in the form of an oblong slot 12. When grinding element 10 is placed on working surface 3 of grinding body 1, openings or holes 11, or the oblong slot 12, coincide with recessed areas 4 between bridge-like blocks 2. The grinding dust generated in the grinding operation penetrates recessed areas 4 through the holes of perforated rows 11 or through oblong slots 12, in order to be sucked away via inlets 5.

Figure 2:
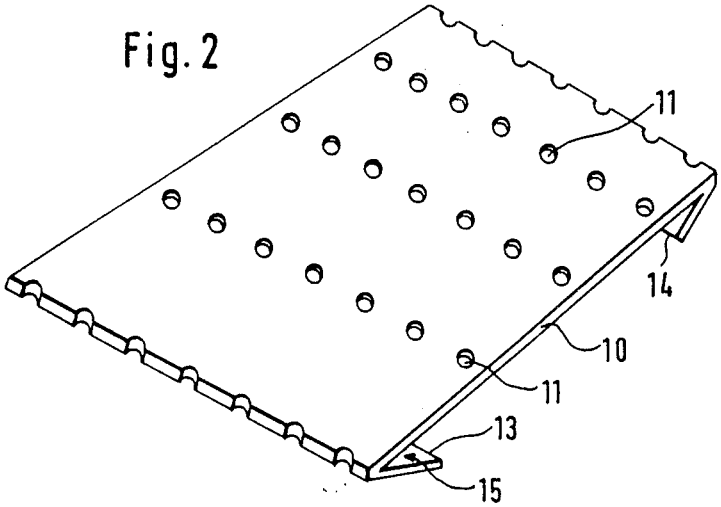
FIG. 2 is an isometric view of a grinding element with its lateral edges folded over.

Referring to FIG. 2, there is shown an isometric view of a grinding element 10 with the rows or lines of holes 11. As shown, the opposite edges 13 and 14 of the grinding element are folded over. The bending line of the folds is predetermined, in each case, by the outer lines of perforations. In this way, lateral areas are formed on the back or second side 15 of the grinding element which are roughened as a result of the abrasive material coating of the folded segments. These roughened lateral areas may be placed into contact with exposed top working surface 3 of end bridge-like blocks 2.

Figure 3:
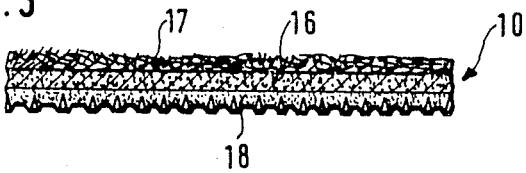
FIG. 3 is a cross-sectional view of the grinding element, showing a roughened layer on the back side thereof on an enlarged scale.

Referring to FIG. 3, there is shown a cross-sectional view through grinding element 10 shown on an enlarged scale. The grinding element consists of a support layer 16 coated on the top side with the abrasive material 17. A roughened layer 18 is applied to the back side, which layer may be formed, for example, by a hot-sealing adhesive applied to the back side, which adhesive is roughened by impressions.

Figure 4:
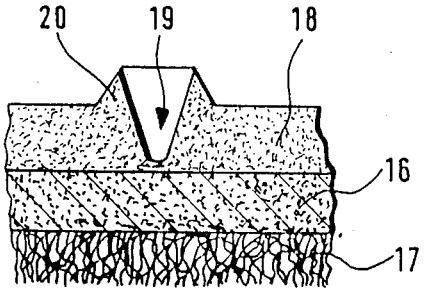
FIG. 4 is a cross-sectional view of a grinding element according to FIG. 3 on a enlarged scale.

Referring to FIG. 4, there is shown a detail of FIG. 3 on an enlarged scale. FIG. 4 shows that a recess 19, which is embossed or otherwise formed in layer 18, for example, by means of needles mounted on needle rolls, forms a roughened contour, as projecting edge beads 20 are formed by the material displaced as the needles penetrate the material.

Figure 5:
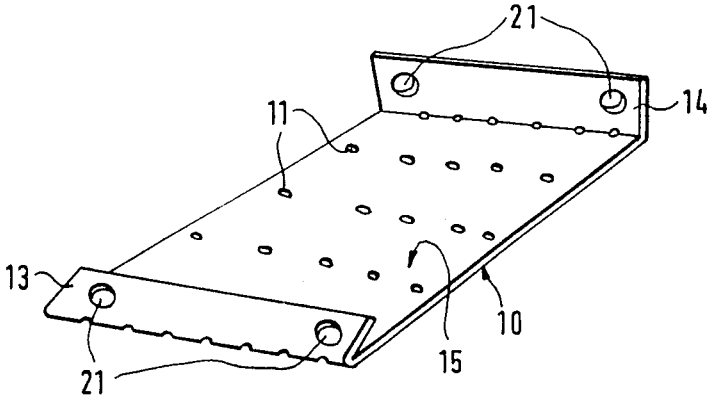
FIG. 5 is an isometric view of the back side of a grinding element.
Figure 6:
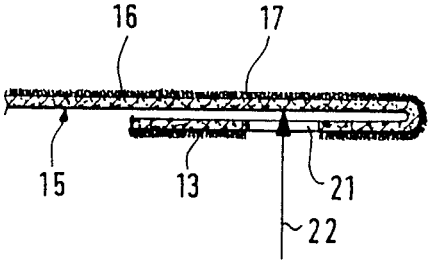
FIG. 6 is a cross-sectional view of a folded edge of the grinding element according to FIG. 4, shown on an enlarged scale.

Referring to FIG. 5, there is shown the back or second side 15 of grinding element 10. A hole 21 is punched in each folded edge 13, 14, such hole coinciding with an outlet opening 9 when the grinding element is placed on a grinding tool body according to FIG. 1. The advantage resulting from such an embodiment is that the adhesion-imparting suction force can act through the hole 21 in the direction of the arrow 22 (FIG. 6), so that particularly thin abrasive paper loses its tendency to bulge in areas disposed opposite folded edge 13, 14.

While several of the embodiments and examples of the present invention have been illustrated and described, it is obvious that many changes and modifications may be made thereunto, without departing from the spirit and scope of the invention.

What is claimed is:

1. A grinding element in combination with a grinding tool body of a vibratory grinding tool, said grinding tool body having suction ducts therein for sucking grinding dust through inlets in recesses in a working surface thereon, the suction inlets being connectable to a vacuum system via the suction ducts in the grinding body, said grinding element comprising:

a sheet coated on a first side with an abrasive material, said sheet having a second side covering the working surface on the grinding body, said sheet having at least two open areas therein coinciding with the recesses in the working surface, said second side of said sheet being roughened to better frictionally engage the working surface;

said sheet being roughened by applying a rough surface layer to said second side of said sheet, said layer being formed by folding a portion of said first side onto said second side, wherein at least two edges of the sheet are folded over, such edges being disposed on opposite sides of said sheet; each folded edge having a folding line;

and said folding line of the folded over edges being predetermined by an associated open area.

2. The grinding element, as defined in claim 1, wherein said roughening is produced on predetermined areas of said second side of said sheet.

3. The grinding element, as defined in claim 1, wherein said sheet is roughened by applying a rough surface layer to said second side of said sheet.

4. The grinding element, as defined in claim 3, wherein said layer is formed by folding a portion of said first side onto said second side.

5. The grinding element, as defined in claim 4, wherein at least two edges of the sheet are folded over, such edges being disposed on opposite sides of said sheet.

6. The grinding element, as defined in claim 5, wherein a folding line of each folded edge is predetermined by a marking applied to the sheet.

7. The grinding element, as defined in claim 5, wherein said working surface has a plurality of second suction inlets connected to the suction ducts and the folded edge serving as said roughened layer has at least one hold arranged in a way such that with said sheet applied to the working surface, such hole coincides with said second suction inlets, said second inlets extending through the working surface of the grinding tool body.

8. The grinding element, as defined in claim 1, wherein said open areas are in the form of a row of holes.

9. The grinding element, as defined in claim 1, wherein each open area is in the form of an oblong slot.

10. The grinding element, as defined in claim 1, wherein adjacent open areas are spaced 10 to 80 millimeters apart.

11. The grinding element, as defined in claim 10, wherein the distance between two adjacent open areas is 40 millimeters.

12. The grinding element, as defined in claim 11, wherein the width of each folded edge is equal to about half the distance between said open areas.

* * * * *